US008171764B2

(12) United States Patent
Sasaki

(10) Patent No.: US 8,171,764 B2
(45) Date of Patent: May 8, 2012

(54) ELECTRONIC LOCK

(75) Inventor: Koichi Sasaki, Kanagawa (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/059,734

(22) PCT Filed: Mar. 15, 2010

(86) PCT No.: PCT/JP2010/001843

§ 371 (c)(1),
(2), (4) Date: Feb. 18, 2011

(87) PCT Pub. No.: WO2010/109806

PCT Pub. Date: Sep. 30, 2010

(65) Prior Publication Data

US 2012/0006083 A1 Jan. 12, 2012

(30) Foreign Application Priority Data

Mar. 26, 2009 (JP) ..... 2009-075556

(51) Int. Cl.
*A44B 15/00* (2006.01)

(52) U.S. Cl. ..... 70/456 R; 70/408

(58) Field of Classification Search ..... 70/408, 70/456 R

See application file for complete search history.

(56) References Cited

U.S. PATENT DOCUMENTS 6,216,501 B1 * 4/2001 Marquardt et al. ..... 70/252
6,460,386 B1 * 10/2002 Watanuki et al. ..... 70/456 R
7,098,791 B2 * 8/2006 Okada ..... 340/568.1
7,290,419 B2 * 11/2007 Balko et al. ..... 70/456 R
7,310,980 B2 * 12/2007 Hashimoto et al. ..... 70/456 R
7,370,501 B2 * 5/2008 Miyata et al. ..... 70/395
7,448,238 B2 * 11/2008 Shimura et al. ..... 70/252
7,513,134 B2 * 4/2009 Hashimoto et al. ..... 70/456 R (Continued)

FOREIGN PATENT DOCUMENTS

CN 1924263 A 3/2007

(Continued)

OTHER PUBLICATIONS

International Search Report for PCT/JP2010/001843 dated Jun. 15, 2010.

*Primary Examiner* — Suzanne Barrett
(74) *Attorney, Agent, or Firm* — Pearne & Gordon LLP

(57) ABSTRACT

Provided is an electronic lock which achieves improved productivity while maintaining the performance of waterproofness for an internal electronic circuit of an insertion portion for a mechanical lock. Specifically provided is an electronic lock provided with a portable machine (1) which contains an electric circuit that locks and/or unlocks a door by communicating with the outside wirelessly, and a mechanical lock which is attachable to and detachable from the portable machine (1) and mechanically locks and/or unlocks the door. In the electronic lock, the portable machine (1) comprises: an upper case (10) and a lower case (20) which house the electric circuit; an inner case (30) within the upper case (10) and lower case (20), in which the electric circuit is disposed; an insertion portion (21) within the lower case (20), into which the mechanical lock is insertable from the front end thereof and which has an opening (23) in the upper surface (22) at the terminal end thereof; and a rubber member (24) which is inserted into the opening (23) of the insertion portion (21).

2 Claims, 7 Drawing Sheets

U.S. PATENT DOCUMENTS

| | | | | |
|---|---|---|---|---|
| 7,596,977 | B2 * | 10/2009 | Eychenne et al. | 70/257 |
| 7,634,932 | B2 * | 12/2009 | Cadiz et al. | 70/456 R |
| 7,690,233 | B2 * | 4/2010 | Katagiri et al. | 70/456 R |
| 7,698,920 | B2 * | 4/2010 | Yamaguchi et al. | 70/396 |
| 7,726,161 | B2 * | 6/2010 | Canard et al. | 70/456 R |
| 7,930,915 | B2 * | 4/2011 | Katagiri | 70/252 |
| 8,001,817 | B2 * | 8/2011 | Yamaguchi et al. | 70/396 |
| 8,011,214 | B2 * | 9/2011 | Katagiri et al. | 70/252 |
| 2006/0260370 | A1 * | 11/2006 | Miwa et al. | 70/456 R |
| 2007/0044525 | A1 | 3/2007 | Katagiri et al. | |
| 2007/0079639 | A1 * | 4/2007 | Hsu | 70/456 R |
| 2007/0131530 | A1 * | 6/2007 | Burca et al. | 200/515 |
| 2007/0137269 | A1 * | 6/2007 | Morehart et al. | 70/408 |
| 2007/0220936 | A1 * | 9/2007 | Miyata et al. | 70/408 |
| 2008/0105015 | A1 * | 5/2008 | Hashimoto et al. | 70/456 R |
| 2008/0127693 | A1 * | 6/2008 | Cadiz et al. | 70/456 R |
| 2008/0229794 | A1 * | 9/2008 | Fujimoto | 70/456 R |
| 2010/0123548 | A1 * | 5/2010 | Choi | 340/5.64 |

FOREIGN PATENT DOCUMENTS

| | | | |
|---|---|---|---|
| CN | 200985684 | Y | 12/2007 |
| EP | 1 327 734 | A1 | 7/2003 |
| JP | 2001-130381 | A | 5/2001 |
| JP | 2003-201781 | A | 7/2003 |
| JP | 2007-63921 | A | 3/2007 |
| JP | 2007-258315 | A | 10/2007 |
| JP | 2008-025145 | A | 2/2008 |
| JP | 2008-31544 | A | 2/2008 |

* cited by examiner

ELECTRONIC LOCK

TECHNICAL FIELD

The present invention relates to an electronic lock with a mechanical lock, for use in a remote control system for opening and closing a door.

BACKGROUND ART

These years, a remote control system using an electronic lock is mounted in a vehicle. This remote control system locks and/or unlocks a door of a vehicle in a non-contact manner, by performing wireless communication between a control unit mounted in the vehicle, and an electronic lock which a user carries. An electronic lock is carried outside a vehicle by a user, and therefore needs be water-proof and dust-proof to prevent the inner electronic circuitry from failing. In addition, considering an emergency case where the electronic circuitry inside an electronic lock cannot perform wireless communication, providing in an electronic lock a mechanical lock for locking and/or unlocking a door of a vehicle mechanically, is being studied (see, for example, patent literature 1).

FIG. 1 shows a conventional electronic lock provided with a mechanical lock. As shown in FIG. 1, the electronic lock has mobile device 1 and mechanical lock 100. Mobile device 1 is covered by upper case 10 and lower case 20, and insertion section 21 is formed in lower case 20. Mechanical lock 100 is comprised of holding section 101 and bar-shaped section 102. This bar-shaped section 102 is inserted in insertion section 21 in a removable fashion. Given the requirement to make the electronic circuitry inside mobile device 1 water-proof and dust-proof, the shape of insertion section 21 needs to be formed a saclike shape inside mobile device 1.

FIG. 2A illustrates the first step of a conventional molding method of forming insertion section 21 shown in FIG. 1. FIG. 2B illustrates a second step of a conventional molding method of forming insertion section 21 shown in FIG. 1. FIG. 2C illustrates a third step of a conventional molding method of forming insertion section 21 shown in FIG. 1. In FIG. 2, the direction from the left to the right in the drawing is the direction of insertion of mechanical lock 100 into mobile device 1.

First, as shown in FIG. 2A, first metallic mold 201, second metallic mold 202 and third metallic mold 203 are fitted together so as to form space 204 for pouring in resin. Here, although not illustrated, an opening for pouring resin in space 204 is formed in a left part of second metallic mold 202 in contact with third metallic mold 203 in the drawing. Third metallic mold 203 is comprised of base section 203*a* that fits together with first metallic mold 201 and second metallic mold 202, and projecting section 203*b* that extends from base section 203*a* to the right in this drawing in a pointing shape.

The shape of this projecting section 203*b* is approximately the same as the shape of bar-shaped section 102 of mechanical lock 100, and is long along the insertion direction and thin. By this means, when resin is poured in space 204, the resin flows in the lower part of space 204 in the drawing, toward the right in the drawing, which is the direction of insertion of mechanical lock 100. Then, when the resin reaches the right end of space 204 in the drawing, the resin then flows upward in space 204, and, upon reaching the front end, flows toward the left in the drawing, which is the direction of removal of mechanical lock 100. The upward molding pressure produced by the flow of resin in space 204, applies to the front end of projecting section 203*b*. To prevent the front end of this projecting section 203*b* from shaking, press pin 205 presses against projecting section 203*b* from above.

Next, as shown in FIG. 2B, before resin 206 poured in the configuration of FIG. 2A solidifies completely, press pin 205 is pulled out up to the inner wall surface of first metallic mold 201 using a special cylinder, while maintaining first metallic mold 201 and second metallic mold 202 closed. Then, in the part of first metallic mold 201 from which press pin 205 has been pulled out, resin is poured again. Finally, as shown in FIG. 2C, first metallic mold 201, second metallic mold 202 and third metallic mold 203 are taken apart, and insertion section 21 comprised of frame body 208 and opening section 209 is formed.

Citation List

Patent Literature

PTL 1: Japanese Patent Application Laid-Open No. 2008-25145

SUMMARY OF INVENTION

Technical Problem

However, with a conventional technique, the step of pouring resin for a second time in the part in space 204 where press pin 205 has been present requires a special molding tool for pulling out only press pin 205 while maintaining first metallic mold 201 and second metallic mold 202 closed, and furthermore is time consuming. That is to say, a conventional technique has a problem with the productivity of electronic locks.

It is therefore an object of the present invention to provide an electronic lock that improves productivity while maintaining the water-proofness of inner electronic circuitry.

Solution to Problem

An electronic lock according to the present invention comprises a mobile device that incorporates an electric circuit that wireless-communicates with the outside and locks and/or unlocks a door, and a mechanical lock that can be attached to the mobile device in a removable fashion and that locks and/or unlocks the door mechanically, and, in this electronic lock, the mobile device comprises: a case, in which the electric circuit is accommodated; an inner case which is provided in the case and in which the electric circuit is placed; an insertion section, which is provided in the case, in which the mechanical lock can be inserted from a front end section, and which has an opening section in an upper surface of a terminal end section; and a cover section that is fitted in the opening section in the insertion section.

Advantageous Effects of Invention

With the present invention, upon forming an insertion section for a mechanical lock in an electronic lock, a step of pouring in resin for a second time is not necessary, and a special molding tool for pulling out only a press pin while maintaining first metallic mold 201 and second metallic mold 202 closed, is not necessary. Consequently, the present invention is able to provide an electronic lock that reduces the time for manufacturing and improves productivity while maintaining water-proofness.

DESCRIPTION OF EMBODIMENTS

Figure 1:
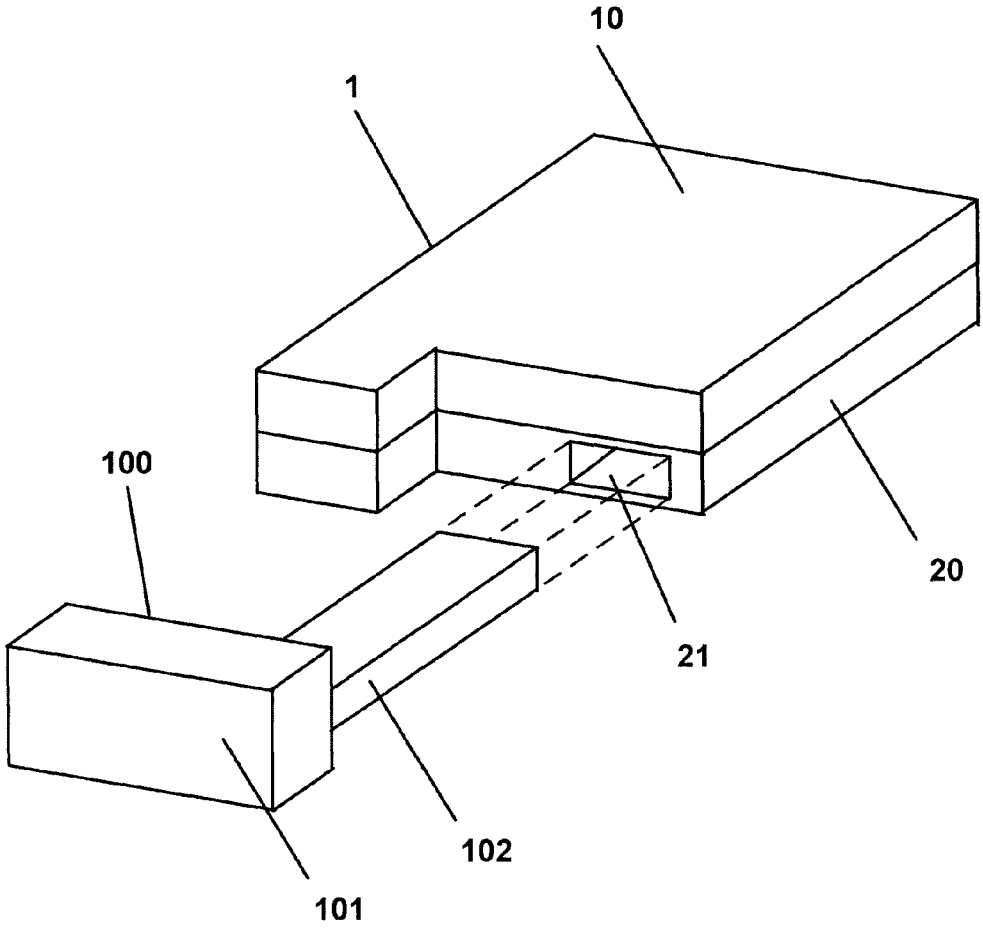
FIG. 1 shows a conventional electronic lock with a mechanical lock.

Now, embodiments of the present invention will be described below with reference to the accompanying drawings. In the following embodiments, parts of the electronic lock of the present invention that are the same as in the conventional configuration of FIG. 1 will be assigned the same reference codes and their detailed explanations will be omitted. Also, the z axis direction is the upward direction in the drawings.

(Embodiment 1)

Figure 3:
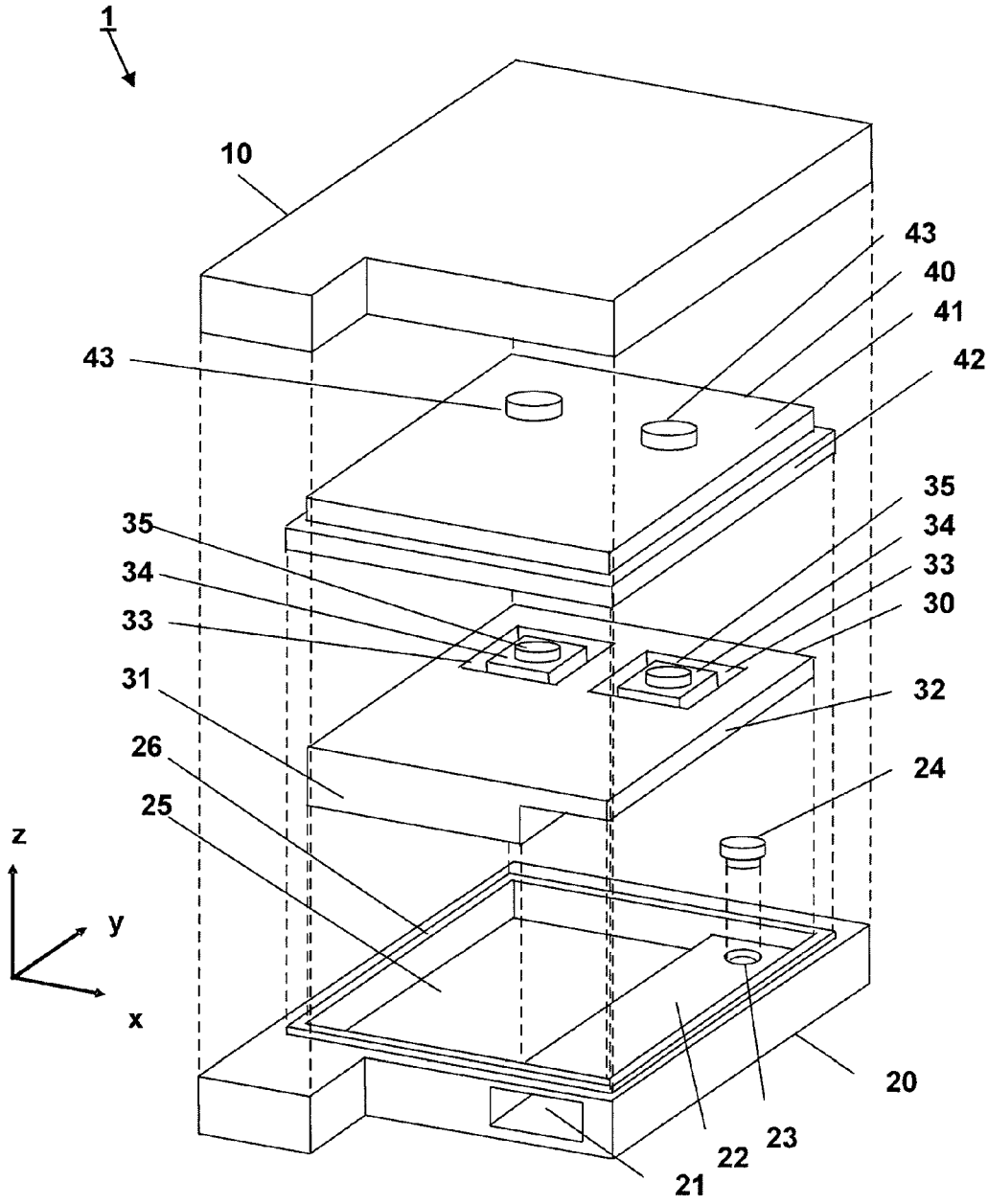
FIG. 3 is an exploded perspective view of a mobile device in an electronic lock according to embodiment 1 of the present invention.

FIG. 3 is an exploded perspective view of mobile device 1 in an electronic lock according to embodiment 1 of the present invention. As shown in FIG. 3, mobile device 1 is comprised of upper case 10, lower case 20, inner case 30 and packing 40.

Upper case 10 is coupled with lower case 20, and accommodates inner case 30 and packing 40 inside. Insertion section 21, in which a bar-shaped section (which is in FIG. 2 bar-shaped section 102) of a mechanical lock (which is in FIG. 2 mechanical lock 100) can be inserted is formed from the front end section to the terminal end section of lower case 20 along the y-axis direction in FIG. 3. In upper surface 22 of this insertion section 21, opening section 23 is provided in a terminal end section. This opening section 23 is closed by fitting in rubber member 24. Also, lower case 20 has lowered section 25 that is dented in the z axis direction from upper surface 22 of insertion section 21. Furthermore, in lower case 20, projecting section 26 is raised in the z axis direction and encloses upper surface 22 of insertion section 21 and lowered section 25. With this projecting section 26, upper surface 22 of insertion section 21 and lowered section 25 form a recess.

Inner case 30 has projecting section 31 to be placed over lowered section 25. Inner case 30 has step section 32, which is lower than projecting section 31 in height in the z axis direction. This step section 32 is placed over upper surface 22 of insertion section 21. Also, opening sections 33 are provided in the upper surface of inner case 30. Piezoelectric sensor 34 and key switch 35 connected on this piezoelectric sensor 34 stick out from each opening section 33.

Figure 4:
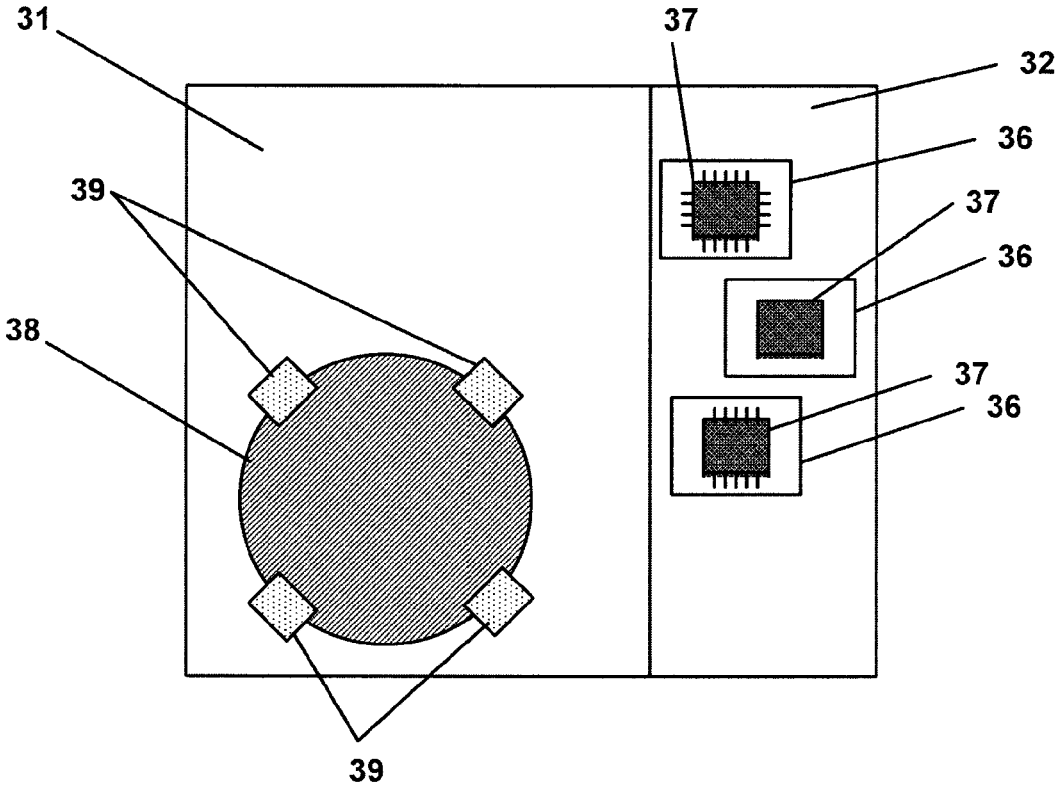
FIG. 4 is a plan view showing a back surface of an inner case, which is a principle part of embodiment 1 shown in FIG. 3, along the z axis direction.

FIG. 4 is a plan view showing the back surface of inner case 30 of FIG. 3 along the z axis direction. Opening sections 36 are provided on the step section 32 side of inner case 30. From each opening section 36, electric circuit 37 incorporated inside inner case 30 is exposed. Also, on the projecting section 31 side of inner case 30, battery 38 for driving electric circuits 37 is provided. Battery 38 is fixed by means of holding sections 39. When key switches 35 are pressed, electric circuits 37 detect this via piezoelectric sensors 34, and perform a process for locking and/or unlocking a door.

Packing 40 is formed by a rubber material, and has: main body section 41 that is placed over inner case 30; flange section 42 that overhangs from the outer periphery of main body section 41 in x-y plane directions; and projecting sections 43 that project from the upper surface of main body section 41 and are placed over key switches 35. The lower surface of this flange section 42 contacts the upper surface of projecting section 26.

Figure 5:
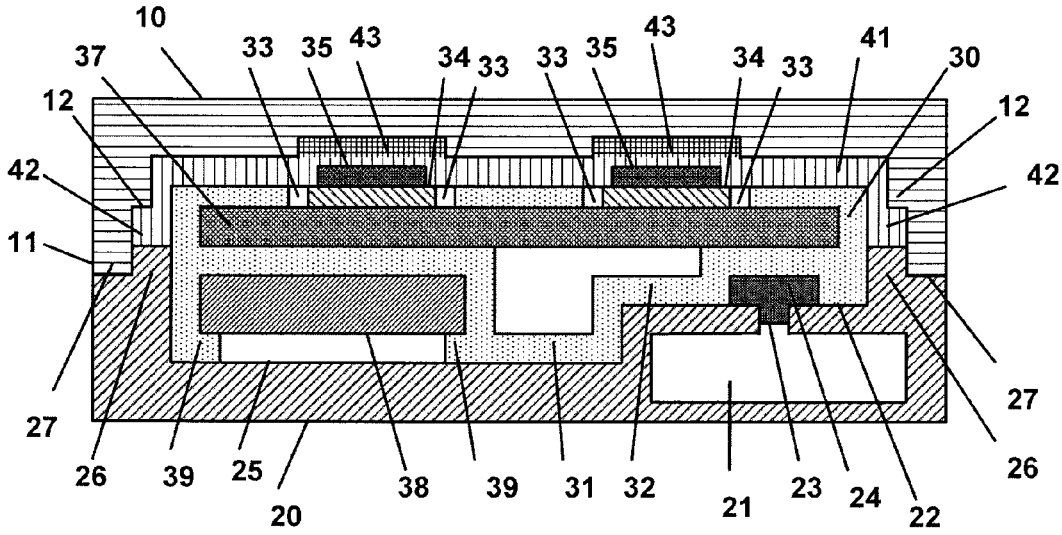
FIG. 5 is cross sectional view, showing a mobile device, which is a principle part of embodiment 1 shown in FIG. 3, cut along an x-z plane passing a rubber member when the parts of the mobile device are assembled together, seen from the positive y axis direction.

Provided that the parts of mobile device 1 in FIG. 3 are assembled, FIG. 5 is a cross sectional view of mobile device 1 cutting mobile device 1 along an x-z plane passing rubber member 24, seen along the positive y axis direction. As shown in FIG. 5, projecting sections 11 provided in lower surfaces on outer peripheries of upper case 10, and mounting sections 27 formed on the periphery side of projecting sections 26 of lower case 20. By this means, mobile device 1 is sealed tight from outside. Also, the lower surfaces of flange sections 42 of packing 40 are placed upon projecting sections 26, and step sections 12, provided on the inner periphery side of projecting sections 11 of upper case 10, fit with upper surfaces of flange sections 42. By this means, the liquid-tightness of electric circuits 37 in inner case 30 is guaranteed.

Figure 6:
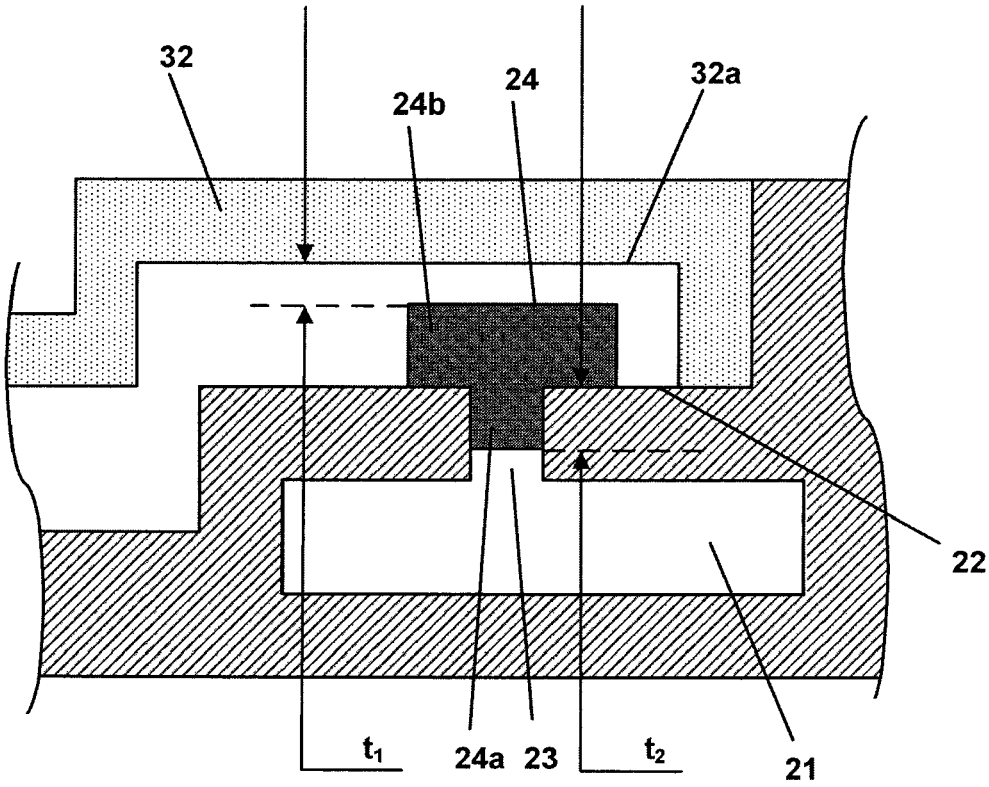
FIG. 6 is an enlarged view of an area around a rubber member, which is a principle part of embodiment 1 shown in FIG. 5.

FIG. 6 is an enlarged view of an area around rubber member 24 of FIG. 5. As shown in FIG. 6, rubber member 24 has bar-shaped section 24*a* and flange sections 24*b* that overhang from the upper end side of bar-shaped section 24*a* to the outer periphery side. Bar-shaped section 24*a* is fitted in opening section 23 in upper surface 22 of insertion section 21. The lower surfaces of flange sections 24*b* contact upper surface 22 of insertion section 21.

As shown in FIG. 6, height $t_1$ of the space from lower surface 32*a* of step section 32 to the upper surface of flange sections 24*b*, is lower than height $t_2$ from upper surface 22 of insertion section 21 to the lower surface of bar-shaped section 24*a*. By this means, when rubber member 24 is fitted in opening section 23 in upper surface 22 of insertion section 21, this assembling does not even require an adhesive. That is to say, even if rubber member 24 is moved upward by pressure from the insertion section 21 side, the distance rubber member 24 moves upward is kept, at maximum, to height $t_1$ when the upper surface of flange sections 24*b* contact lower surface 32*a* of step section 32. Then, as described above, height $t_2$ from upper surface 22 of insertion section 21 to the lower surface of bar-shaped section 24*a*, is higher than height $t_1$ of the space from the lower surface of step section 32 to the upper surface of flange sections 24*b*. Consequently, bar-shaped section 24*a* is maintained in a state of being fitted in, without falling from opening section 23 in upper surface 22 of insertion section 21.

Figure 2A:
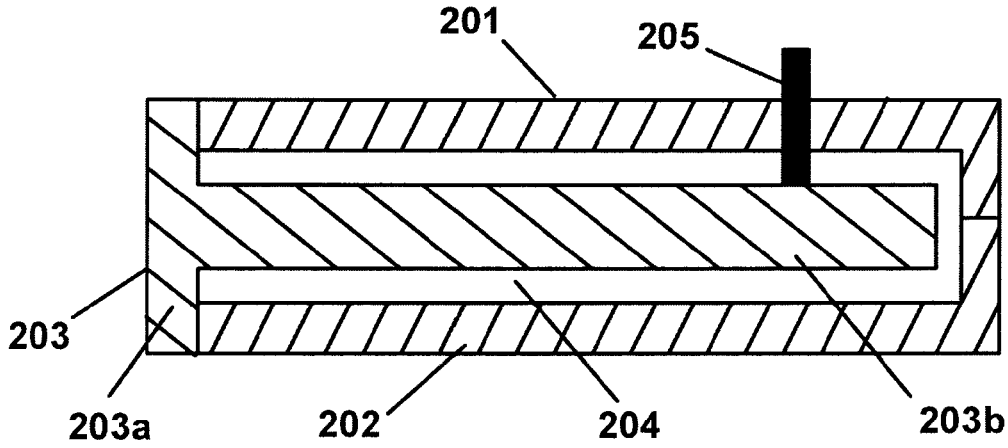
FIG. 2 shows the first through third steps of a molding method for forming the insertion section shown in FIG. 1.
Figure 2B:
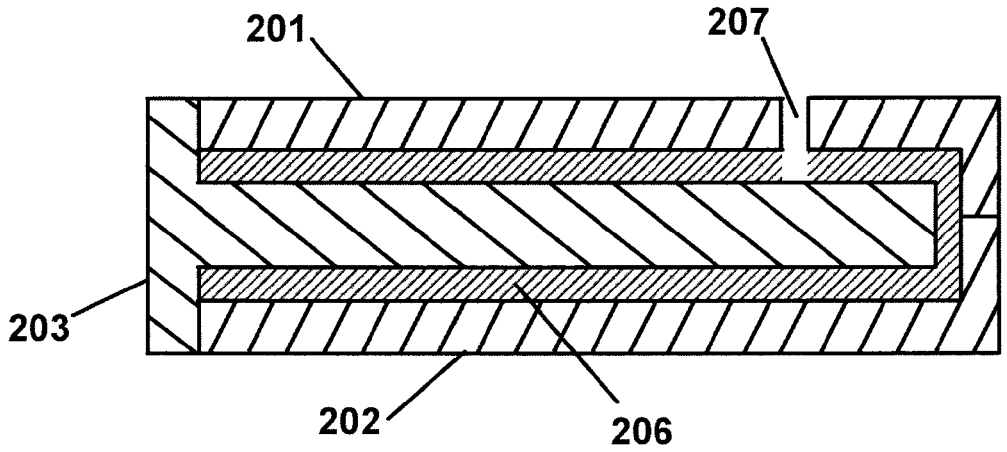
Figure 2C:
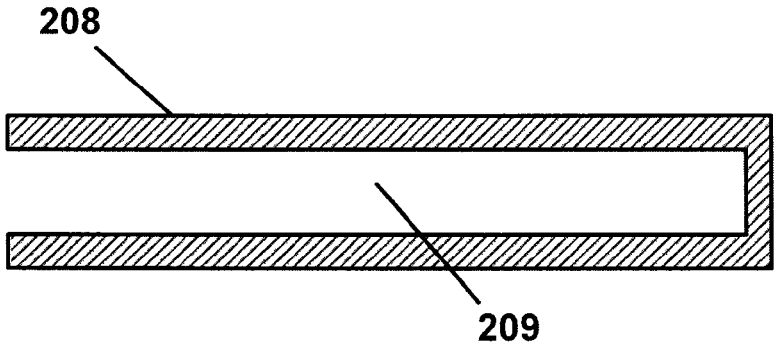

With the present embodiment, upon forming insertion section 21 in mobile device 1, compared to the conventional method illustrated in FIG. 2, it is possible to omit the process of pouring resin in opening 207 for a second time as illustrated in FIG. 2B, and replace this with a step of fitting in rubber member 24. By this means, it is possible to omit a step of pulling out press pin 205 while leaving first metallic molds 201-203. Then, first metallic molds 201-203 and press pin 205 can be removed in the same one step, so that it is not necessary to use a special cylinder for removing only press pin 205. Consequently, it is possible to manufacture an electronic lock, without relying upon how to control the operation, the duration of ejection and the timing of ejection with a cylinder, so that productivity can be improved by reducing the tact time, while still maintaining water-proofness.

Although a case has been described above with the present embodiment where the present invention is applied to an electronic lock for use for opening and closing a door of a vehicle, the present invention is equally applicable to an electronic lock for different usage, such as opening and closing a door of a house.

(Embodiment 2)

Embodiment 2 of the present invention will be described now. Parts that are the same as in embodiment 1 of the present invention will be assigned the same reference codes and their explanations will be omitted.

Figure 7:
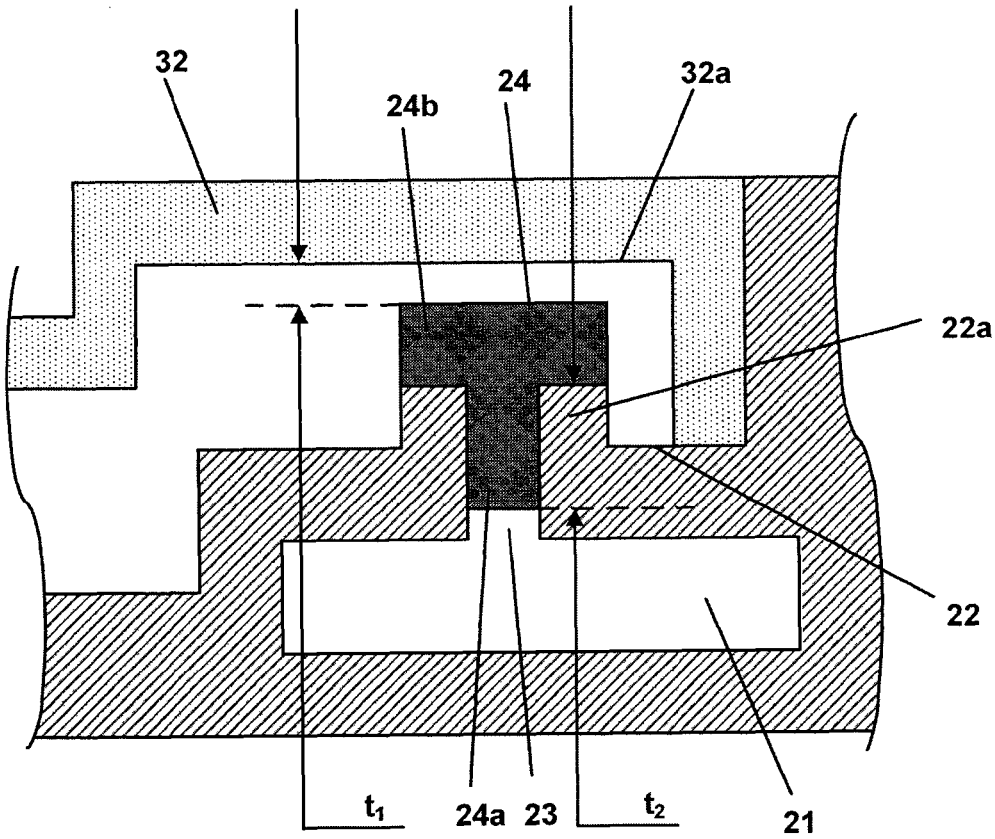
FIG. 7 is an enlarged view of an area around a rubber member according to embodiment 2 of the present invention.

FIG. 7 is an enlarged view of an area around rubber member 24 according to embodiment 2, and corresponds to FIG. 6. As shown in FIG. 7, in upper surface 22 of insertion section 21, edge sections 22*a* that project upward are formed on perimeter edges of opening section 23. These edge sections 22*a* can guide rubber member 24. Consequently, it is possible to fit rubber member 24 in opening section 23 provided in upper surface 22 of insertion section 21 at ease.

The disclosure of Japanese Patent Application No. 2009-75556, filed on Mar. 26, 2009, including the specification, drawings and abstract, is incorporated herein by reference in its entirety.

Industrial Applicability

The electronic lock of the present invention is suitable for use as an electronic lock with a mechanical lock to use in a remote control system for, for example, opening and closing a door of a vehicle or house.

Reference Signs List

1 Mobile device
10 Upper case
20 Lower case
21 Insertion section
22 Upper surface
23 Opening section
24 Rubber member
24*a* Bar-shaped section
24*b* Flange section
30 Inner case
37 Electric circuit
100 Mechanical lock

The invention claimed is:

1. An electronic lock comprising a mobile device that incorporates an electric circuit that wireless-communicates with the outside and locks and/or unlocks a door, and a mechanical lock that can be attached to the mobile device in a removable fashion and that locks and/or unlocks the door mechanically, wherein:

the mobile device comprises:

a case, in which the electric circuit is accommodated;

an inner case which is provided in the case and in which the electric circuit is placed;

an insertion section, which is provided in the case, in which the mechanical lock can be inserted from a front end section, and which has an opening section in an upper surface of a terminal end section; and a cover section that is fitted in the opening section in the insertion section; and a height from a lower surface of the inner case to an upper surface of a flange section is lower than a height of a bar-shaped section.

2. The electronic lock according to claim 1, wherein the cover section comprises:

the bar-shaped section that is in close contact with a wall surface forming the opening section in the insertion section; and the flange section that overhangs from an upper end of the bar-shaped section in a flange shape.

* * * * *